US006070750A

United States Patent [19]

Kubitz

[11] Patent Number: 6,070,750

[45] Date of Patent: Jun. 6, 2000

[54] REINFORCED CONTAINER AND METHOD FOR PRODUCING SAME

[76] Inventor: Terry E. Kubitz, 7756 Woodward Ave., Woodbridge, Ill. 60517

[21] Appl. No.: 07/789,802

[22] Filed: Nov. 12, 1991

Related U.S. Application Data

[63] Continuation of application No. 07/233,856, Aug. 18, 1988, abandoned, which is a continuation of application No. 06/936,613, Dec. 1, 1986, abandoned.

[51] Int. Cl.[7] ..... B65D 6/30; B65D 23/36

[52] U.S. Cl. ..... 220/62.22; 53/442; 220/619; 220/648

[58] Field of Search ..... 220/461, 619, 220/62.11, 62.12, 62.22, 639, 646, 648; 40/306; 206/459, 497; 53/442; 215/1 C, 12.2, 12.1; 426/131; 156/86; 413/2, 6, 27

[56] References Cited

U.S. PATENT DOCUMENTS

| | | | |
|---|---|---|---|
| B 223,678 | 3/1976 | Nixon et al. | 220/606 X |
| 1,854,424 | 4/1932 | Peelle | 413/2 X |
| 2,558,705 | 6/1951 | Hermann | 413/27 |
| 2,810,492 | 10/1957 | Bergen et al. | 220/71 X |
| 3,110,554 | 11/1963 | Yazumi | 40/306 X |
| 3,406,891 | 10/1968 | Buchner et al. | 220/67 X |
| 3,501,047 | 3/1970 | Raabe | 220/71 |
| 3,556,031 | 1/1971 | Frankenberg | 413/6 |
| 3,589,506 | 6/1971 | Ford et al. | 426/131 X |
| 3,698,596 | 10/1972 | Potts | 220/619 |
| 3,747,746 | 7/1973 | Newman et al. | 53/442 X |
| 3,799,423 | 3/1974 | Cuacho | 220/619 X |
| 3,863,373 | 2/1975 | Kaercher et al. | 40/306 |
| 3,972,435 | 8/1976 | Saski et al. | 215/12.2 |
| 4,129,225 | 12/1978 | Bailey | 215/1 C |
| 4,138,026 | 2/1979 | Conklin | 215/12.2 |
| 4,151,927 | 5/1979 | Cuacho et al. | 220/609 X |
| 4,187,276 | 2/1980 | Amberg | 53/442 X |
| 4,190,168 | 2/1980 | Jacques | 156/86 X |
| 4,248,030 | 2/1981 | Heckman | 53/442 X |
| 4,315,573 | 2/1982 | Bradley et al. | 215/12.2 |
| 4,402,419 | 9/1983 | MacPherson | 220/1 BC |
| 4,526,290 | 7/1985 | Cerny | 215/1 C |
| 4,538,758 | 9/1985 | Griffith | 220/67 X |
| 4,608,284 | 8/1986 | Roales | 215/12.2 X |
| 4,844,957 | 7/1989 | Hoffman | 215/12.1 X |

FOREIGN PATENT DOCUMENTS

| | | | |
|---|---|---|---|
| 2289394 | 5/1976 | France | 53/442 |

*Primary Examiner*—Allan N. Shoap
*Assistant Examiner*—Niki M. Eloshway
*Attorney, Agent, or Firm*—William H. Holt

[57] ABSTRACT

A reinforced container, particularly of thin gauge metal, is encircled by a thermoplastic sleeve which is shrunk thereabout for applying a radial squeezing force to give the container adequate axial strength for withstanding the axial compressive pressures of conventional filling and closing machines.

16 Claims, 2 Drawing Sheets

REINFORCED CONTAINER AND METHOD FOR PRODUCING SAME

This is a continuation of application Ser. No. 233,856 filed Aug. 18, 1988, abandoned, which is a continuation of application Ser. No. 936,613 filed on Dec. 1, 1986, abandoned.

This invention relates to new and improved reinforced containers and methods for producing such containers, and more particularly to thin gauge metal cans having thermoplastic shrink bands for increasing axial strength of such cans for withstanding the compressive forces applied by conventional closing machines.

BACKGROUND OF THE PRIOR ART

Thermoplastic shrink bands have been in the marketplace for over 20 years. Such bands have been made either in the form of a continuous tube or as a continuous flat film which is seamed to form a continuous tube which is subsequently cut into desired lengths.

Shrink bands can be transparent, or colored, or printed and used primarily as neck or cap seals for tamper-evidence, or are used as labels if they contain printed material. The use of labels has been common on glass or plastic containers, but labels have been very seldom used on metal cans because of costs.

Heretofore, the most common material used for shrink bands has been polyvinyl chloride (P.V.C.). Other materials which can be used, but are less common, are polyester, polyethylene terephthlate (P.E.T.), polystyrene and polypropylene.

In the container art, particularly in the metal can industry, one way of reducing costs has been to make the cans of thinner metal. The limiting factor is, however, the strength of the can. After a can is filled with a product, such as a beverage or food product, it goes into a can seamer that applies a metal end and seams it to the top or open end of the can. In order to get a good seal, the can seamer must exert a great deal of downward pressure on the can end and top of the can. This downward pressure, which is tropically in excess of 100 pounds and may be 200 pounds or more, causes a weak or thin walled can to collapse or buckle. The collapse of a single can in a high production assembly line can cause a large expenditure of time and money incident to stoppage of the line and the requisite clean-up effort. Thus, it is essential that each can has sufficient strength, known as its "axial strength", to withstand the maximum downward, or axial, pressure which is to be encountered.

U.S. Pat. No. 3,542,229 teaches the use of a shrink band of stretchable heat-shrinkable plastic film for increasing the burst strength of a thermoplastic bottle, and teaches the use of a plurality of bands.

U.S. Pat. No. 3,754,699 teaches that a container may be reinforced adjacent the closure receiving flange by using a narrow band as is best shown in FIG. 2.

U.S. Pat. No. 4,007,246 teaches reinforcement of the neck and shoulder portion of a bottle and differential reinforcement of the bottle with the greatest reinforcement being in the neck and shoulder area. There is no teaching or suggestion of reinforcement of the bottle in an axial direction.

U.S. Pat. No. 3,698,586 teaches the expedient of applying a shrinkable sheet around the shoulder area of a bottle.

The above-mentioned patents relate to reinforcement of plastic and glass bottles. U.S. Pat. Nos. 2,810,492 and 3,072,517 teach that a metal can or drum may be reinforced by winding a plurality of layers of paper around the outer periphery thereof. While the first patent makes specific reference to drums, it is noted that in the embodiment of FIG. 2, a closure 31 is applied by using a band 32 which is double seamed to the body. The second patent, i.e., U.S. Pat. No. 3,072,517, discusses axial reinforcement but it is to be noted that the wound paper sheath 12 is incorporated in a double seam as shown in FIG. 3.

The prior art discussed above does not teach or suggest a solution to the problem of axial collapse of a can body during the seaming of a can end onto the can body, and particularly a can body which is necked-in adjacent the closure receiving end.

SUMMARY OF THE INVENTION

The invention relates to axial reinforcement of a container body, such as new plastic cans presently entering the marketplace and more particularly a can body formed of thinner than normal metal, to provide the container body with increased strength and make it capable of withstanding the large pressure or axial load experienced during a closing operation.

I have tested various materials to be used in my invention and have proven that the most common material used heretofore for shrink bands, namely, polyvinyl chloride (P.V.C.), does not have a "compression" force when shrinking and it does not enhance the axial strength of a container body when the band is shrunk therearound; in other words, it does not squeeze the object. Materials such as polyester, P.E.T. and polypropylene do exhibit a compressive force and will improve the axial strength of a container body. It appears, but has not yet been completely proven or understood, that the greater the compressive force used, the greater the increase is found in the axial strength of the improved container body.

Conventional container bodies can fail or give way in the sidewall or body thereof, or may fail in a necked-in area, depending upon the design and strength of the side wall and/or necked-in area. My improved container body and method for forming such improved container body comprises shrinking a band or tube onto an empty container body wherein the band or tube is formed of material which exhibits compressive strength when shrunk by subjecting it to heat or other types of shrinking processes. In the case of thin metal can bodies, the band or tube extends from under the closure flange to the bottom in order to improve the overall strength. If the particular style or design has sufficient strength at the necked-in area, a band would be applied, and shrunk about the sidewall or body; similarly, if the car body is strong enough, but it is weak in the necked-in area, a band would be applied and shrunk only in that area.

It is an object of the invention to provide a reinforced container comprising a tubular container body having at least one end having an opening for receiving product, means on the one end for receiving an end closure, a thermoplastic sleeve surrounding at least a portion of the tubular container body and shrunk thereon for radially inwardly squeezing the container body for increasing the axial strength thereof.

Another object of the invention is to provide a reinforced container as described above wherein the container body is formed of metal and includes an end closure at least a portion of the thermoplastic sleeve being disposed between the metal can body and the end closure and entrapped by a seamed portion of the end closure.

A further object of the invention is to provide a reinforced container body as described above wherein the end of the container adjacent the end closure is necked-in.

A still further object of the invention is a method of providing a strengthened container, the method comprising the steps of providing a tubular container body having at least one open end, encircling at least a portion of the container body with a thermoplastic film, and subjecting the film to an elevated temperature and shrinking the film for applying compressive force to the container body radially thereof.

Another object of the invention is to provide a method as described above including the steps of placing a container end on the container body at the open end and applying force to the container end and container body axially of the container body for securing the container end to the container body.

An additional object of the invention is to provide a method as described above including the steps of forming the container body of thin gauge metal, creating a necked-in portion adjacent the open end, selecting the thermoplastic film of a material and thickness to create sufficient radial compressive force on the container body to withstand an axially directed load of about 300 pounds without causing collapse of the container body.

Other objects of the invention will be apparent to those skilled in the art after considering the following description of a preferred embodiment of a container and method for producing such a reinforced container.

DETAILED DESCRIPTION OF THE INVENTION

Figure 1:
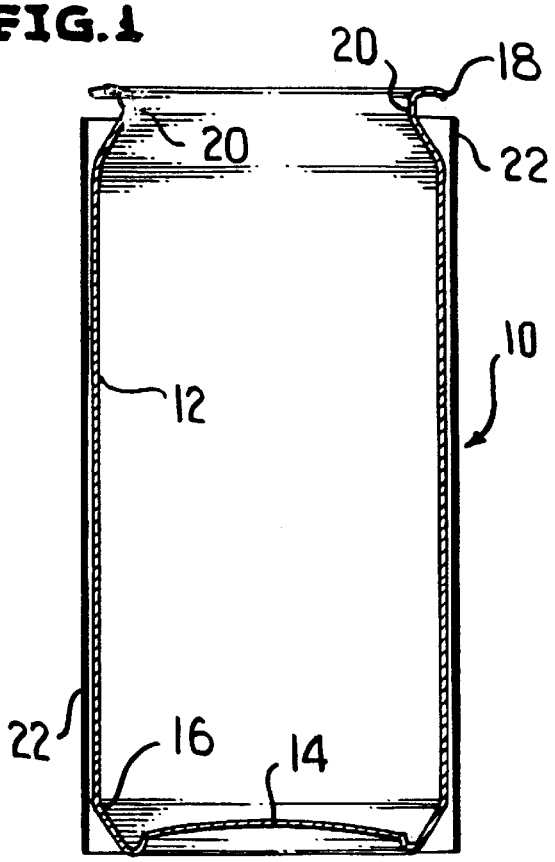
FIG. 1 is a vertical sectional view of a tubular container body which is encircled along its height by a tubular sleeve of thermoplastic film.

A container, generally indicated by the numeral 10, is comprised of a tubular can body 12 and an end member 14 which closes one end 16 for forming the container 10. As shown in the drawings, container 10 is formed in one-piece and is typical of extruded containers formed of metal, such as aluminum, but may also be extruded or blow-molded of thermoplastic material. Further, the present invention is equally applicable to containers wherein the can body and end member are formed separately and then joined together by methods which are well-known in the container making art.

Container 10 includes an outwardly extending flange 18 which is used during a closing operation which will be described in due course. Can body 12 is usually circular in horizontal section although it may be of other shapes such as oval or rectangular. The invention is particularly useful with a can body 12 which is formed circular in section and provided with a necked-in portion 20 formed closely adjacent to flange 18.

A tubular sleeve or shrink band 22 is placed about container 10 and, as is shown in FIG. 1, may extend along the full height of can body 12. The sleeve or band 22 is formed of thermoplastic material, the presently preferred materials being polyester, polyethylene terephthlate, polystyrene and polypropylene, and may be made by being extruded in a continuous tube or be made from flat film which is seamed lengthwise to form a continuous tube. It has been discovered that an unusual characteristic of shrink bands is that they shrink primarily in one direction, that direction being across the diameter of the tube and not in the lineal or height direction. When film is machine formed, the preferential shrink can be about 80 percent across the machine direction and only about 2 percent in the machine direction. Thus, if the sleeve or band 22 is formed from sheet or film, the seam is made in the machine direction to provide the finished tube with its maximum shrink characteristic being in the diametrical or radial direction.

After the sleeve or band 22 is placed about the can body 12, as is shown in FIG. 1, heat is applied and causes the sleeve or band 22 to shrink primarily in the radial direction and subject the can body 12 to a radially directed compressive force. Heat is applied for approximately 4 seconds at a temperature of about 250 degrees F.; of course, these parameters are variable depending upon the particular thermoplastic material and the thickness of the film which may be on the order of one-half to two mils in thickness.

Figure 2:
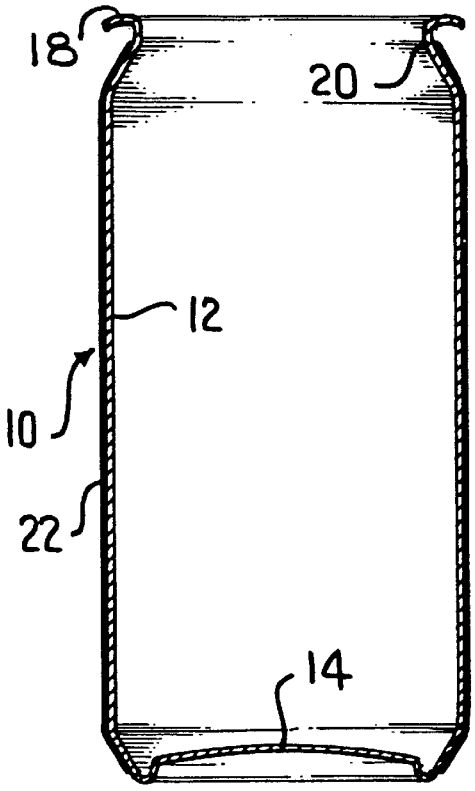
FIG. 2 is an illustration of the container body after the film has been shrunk thereon.

FIG. 2 shows the sleeve or band 22 shrunk about the can body 12. Note that shrinking occurs even at the necked-in portion 20. Product, which may be beverages such as colas, beer or other types of food products, etc., are introduced by conventional filling machines (not shown). In order to prevent spillage, such filling machines temporarily cover the container 10 with a suitable nozzle, or the like, and subjects the container 10 to a downward pressure on the order of about 160 pounds. The characteristic of the container 10 which allows it to resist this downward pressure is its axial strength and it is an important feature of the present invention that the radial compressive force applied by the shrunken sleeve or band 22 increases the axial strength of can body 12 on the order of 5 percent. This surprising increase in axial strength now makes it possible to make the wall of can body 12 thinner than heretofore possible without inviting failure caused by (collapse or buckling. The large economic benefits achieved by using thinner gauge metal or plastic will be readily apparent to those skilled in this art.

Figure 3:
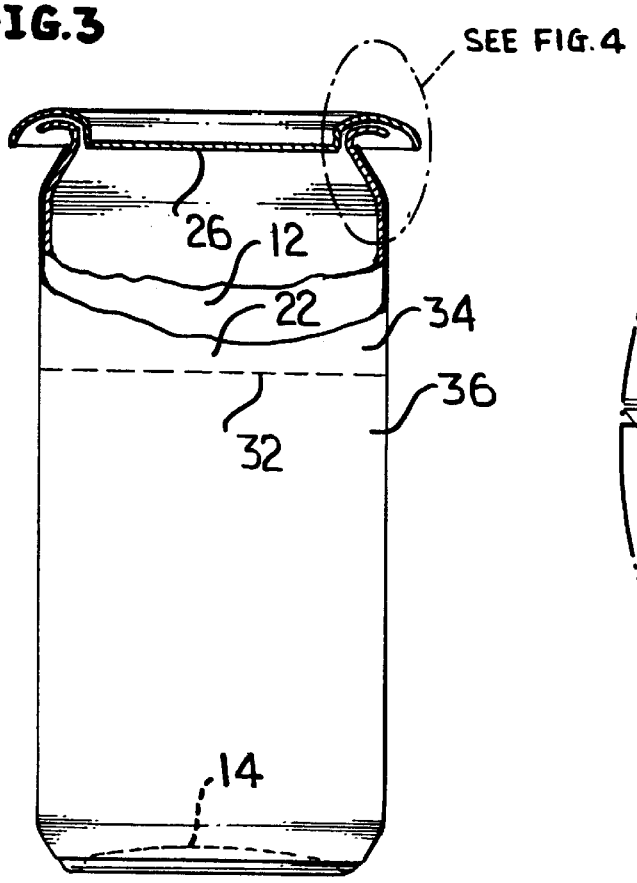
FIG. 3 is an elevational view of a container body, with portions broken away, and shows a can end in position to close the open end.

After container 10 is filled with product, a can end 26 is placed upon flange 18 (as shown in FIG. 3) by a conventional (can seamer (not shown). The can seamer exerts considerable downward pressure on the can end 26 and can body 12 during formation of a seam 28 for sealing container 10, the pressure typically being on the order of 130 pounds.

Figure 4:
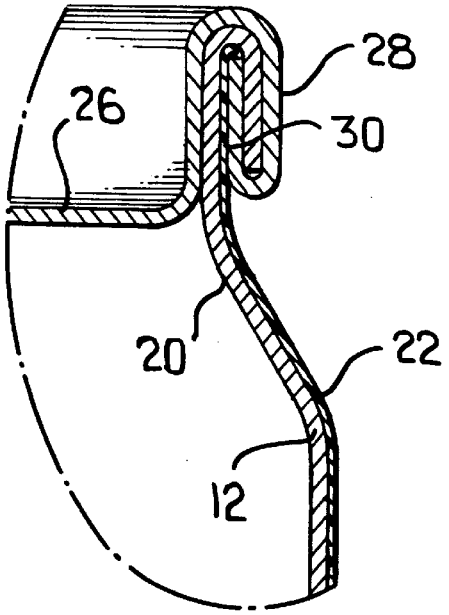
FIG. 4 is a fragmentary view illustrating a portion of the container body and can end of FIG. 3 after the can end has been seamed to the container body and shows a portion of the film entrapped in the seam.

Conventional containers may fail by collapsing or buckling under the pressure exerted by either the filling machine or the can seamer. Failure can occur because of weak spots or small dents which can occur because of rough handling during manufacture, transporter mechanical handling during the filling and seaming operations. Another cause of failure may be attributed to the design of the necked-in portion 20. Note in FIG. 4 that an upper end portion 30, of the shrunken sleeve or band 22, is entrapped within seam 28; it is believed that this feature of the invention provides additional strength to this type of container.

As previously mentioned above, if the can body 12 has enough strength at the necked-in portion 20, the sleeve or band 22 might only be shrunk around a portion of the can body to increase strength in that area; if the can body is strong enough, but the container is weak in the necked-in portion, a sleeve or band might only be used around the necked-in portion to increase strength in that area. This feature is depicted in FIG. 3 by the broken line 32 to illustrate an upper sleeve or band 34 and a separate lower sleeve or band 36. The preferred lengths of bands 34 and 36 will vary depending upon the particular design of the necked-in portion and thickness of the container wall. Depending upon these features it is also possible to use a band 34 and a band 36 of different thickness or even of different thermoplastic material.

While the above descriptions are directed to preferred embodiments of containers and methods for producing the same, it is obvious that various modifications or changes may be made without departing from the spirit or scope of the invention which is to be determined by the following claimed subject matter.

I claim:

1. A reinforced container comprising a tubular container body, said container body having at least one end having an opening for receiving product, means on said one end for receiving an end closure, a thermoplastic sleeve surrounding at least a portion of said tubular container body and shrunk thereon for radially inwardly squeezing said container body for increasing the axial strength thereof, wherein said container body includes, an end closure, and at least a portion of said thermoplastic sleeve is disposed between said container body and said end closure.

2. A reinforced container as defined in claim 1 wherein said container body is formed of metal and comprises a metal can body.

3. A reinforced container as defined in claim 2 wherein said end closure is formed of metal, said end closure being seamed to said can body, and said portion of said thermoplastic sleeve being entrapped between said can body and a seamed portion of said end closure.

4. A reinforced container as defined in claim 3 wherein said one end of said container is necked-in.

5. A reinforced container as defined in claim 4 wherein said thermoplastic sleeve is formed of polyester material.

6. A reinforced container as defined in claim 4 wherein said thermoplastic sleeve is formed of polypropylene material.

7. A reinforced container as defined in claim 4 wherein said thermoplastic sleeve is formed of polyethylene terephthlate.

8. A method of providing a strengthened container, said method comprising the steps of:

(a) providing a tubular container body having at least one open end, (b) encircling at least a portion of said container body with a thermoplastic film, (c) subjecting said film to an elevated temperature and shrinking said film for applying compressive force to said container body radially thereof, (d) planing a container end on said container body at said open end, applying force to said container end and said container body axially of said container body for securing said container end to said container body, and (e) locating a portion of said thermoplastic film between said container body and said container end and entrapping said portion during the step of applying force to said container end and said container body.

9. A method as defined in claim 8 including the step of having said container body formed of thin gauge material incapable of resisting said axially applied force in the absence of being supported by said compressive force.

10. A method as defined in claim 8 including the step of selecting said thermoplastic film from the group of materials consisting of polypropylene, polyester and polyethylene terephthlate.

11. A method as defined in claim 8 including the steps of forming said thermoplastic film into an open ended tube, and sliding said tube onto said container body before subjecting said tube to said elevated temperature.

12. A method as defined in claim 8 wherein said container body and said container end are formed of metal and said container body is provided with a necked-in portion adjacent said one open end.

13. A method as defined in claim 12 including the step of providing said thermoplastic film with a thickness of between 0.5 and 2.0 mils, and subjecting said film to said elevated temperature for approximately four seconds at approximately 250° F.

14. A method as defined in claim 13 wherein the step of applying force to said container end and said container body applies a force of approximately 130 pounds in a direction axially of said container body.

15. A method as defined in claim 8 wherein said step of providing said tubular container body includes the step of forming said container body of thin gauge metal, creating a necked-in portion adjacent said open end, and selecting said thermoplastic film of a thickness sufficient to create said radial compressive force on said container body to withstand an axially directed load of about 300 pounds without causing collapse of said container body.

16. A method of providing a strengthened container, said method comprising the steps of:

(a) providing a tubular container body having at least one open end for allowing said container to be filled with product;

(b) encircling at least a portion of said container body with a thermoplastic film; and (c) subjecting said film to an elevated temperature and shrinking said film for applying compressive force to said container body radially thereof prior to filling said container with product and prior to applying an end closure to said open end;

forming said container body of thin gauge material incapable of resisting the axial forces applied during conventional filling and closing operations in the absence of being strengthened by said compressive force created by the shrinking of said film;

filling said container with product through said open end, providing an end closure over said open end, and sealing said container with said end closure; and locating a portion of said thermoplastic film between said container body and said container end and entrapping said portion during the step of sealing said container with said end closure.

* * * * *